US009410496B1

(12) United States Patent
Kirkpatrick et al.

(10) Patent No.: US 9,410,496 B1
(45) Date of Patent: Aug. 9, 2016

(54) APPARATUS AND METHOD FOR USE OF AN $O_2$ SENSOR FOR CONTROLLING A PRIME MOVER

(76) Inventors: William E. Kirkpatrick, Bozeman, MT (US); Jacob Fraser, Bozeman, MT (US)

( * ) Notice: Subject to any disclaimer, the term of this patent is extended or adjusted under 35 U.S.C. 154(b) by 750 days.

(21) Appl. No.: 13/610,180

(22) Filed: Sep. 11, 2012

Related U.S. Application Data

(60) Provisional application No. 61/590,958, filed on Jan. 26, 2012.

(51) Int. Cl.
*F02D 41/14* (2006.01)

(52) U.S. Cl.
CPC ..... *F02D 41/1475* (2013.01); *F02D 41/1454* (2013.01)

(58) Field of Classification Search
CPC ..... F02D 41/2454; F02D 41/1454; F02D 41/2445; F02D 41/1475; F02D 41/0052
See application file for complete search history.

(56) References Cited

U.S. PATENT DOCUMENTS 4,052,970 A 10/1977 Niertit et al.
4,213,435 A 7/1980 Simko
4,216,753 A 8/1980 Inoue et al.
4,240,395 A 12/1980 Simko et al.
4,252,098 A 2/1981 Tomczak et al.
4,478,191 A * 10/1984 Kinoshita ..... F02D 41/0002 123/684
4,980,834 A * 12/1990 Ikeda ..... F02D 41/1474 123/688
5,518,603 A 5/1996 Furuhashi et al.
6,256,981 B1 * 7/2001 Sullivan ..... F02D 41/1441 123/672
7,415,389 B2 * 8/2008 Stewart ..... G05B 11/42 700/26
2007/0276580 A1 * 11/2007 Toda ..... F02D 41/1495 701/108
2008/0270008 A1 * 10/2008 Spivak ..... F02D 41/0025 701/104
2009/0281710 A1 * 11/2009 Mallebrein ..... F02D 41/1497 701/104
2010/0100305 A1 * 4/2010 Bartick ..... F02D 41/1475 701/109
2013/0080035 A1 * 3/2013 Maeda ..... F02D 41/14 701/109

* cited by examiner

*Primary Examiner* — Sizo Vilakazi
(74) *Attorney, Agent, or Firm* — MacMillan, Sobanski & Todd, LLC

(57) ABSTRACT

A control system for an internal combustion engine that utilizes an oxygen sensor signal to control at least one fuel injector while generating a false oxygen sensor signal for input to an engine control unit.

9 Claims, 5 Drawing Sheets

APPARATUS AND METHOD FOR USE OF AN $O_2$ SENSOR FOR CONTROLLING A PRIME MOVER

CROSS-REFERENCE TO RELATED APPLICATIONS

This application claims the benefit of U.S. Provisional Application No. 61/590,958, filed Jan. 26, 2012, the disclosure of which is incorporated herein by reference.

BACKGROUND OF THE INVENTION

This invention relates in general to oxygen sensors and in particular to the utilization of an oxygen sensor with an internal combustion engine.

Internal combustion engines can use Oxygen ($O_2$) sensors to monitor the Air to Fuel Ratio (AFR) and ensure efficient combustion. Ideally, an AFR would be utilized to provide a stoichiometric combustion in which the fuel is completely burned. Stoichiometric combustion for gasoline requires a weight ratio of 14.7 parts of air to one part of fuel.

Referring now to FIG. 1, there is shown a schematic diagram illustrating a prior art internal combustion engine control system 10. The system 10 includes a narrow band $O_2$ sensor 12 that outputs a voltage indicating the presence of oxygen in the exhaust. The sensor output is sent to an Engine Control Unit (ECU) 14 that is responsive to the sensor output to modify a Pulse Width Modulated (PWM) control signal having a variable pulse width and/or duration. The PWM control signal is, in turn, sent to the engine fuel injectors 16. Narrow band sensors used with the ECU output a voltage transitioning between 0 and 1 volts over a narrow range of AFR near 14.7, as illustrated by the graph to the left in FIG. 2. A rich mixture with an AFR just below 14.7 will output a voltage near 1 volt, and a lean mixture with an AFR just above 14.7 will output a voltage approaching 0 volts, as illustrated by the graph to right in FIG. 2. The graphs shown in FIG. 2 illustrate the AFR output for an idealized $O_2$ sensor output, while the graphs shown in FIG. 3 illustrate the AFR output for a typical $O_2$ actual sensor output. The ECU 14 will add fuel to the air-fuel mixture if there is a lean condition, and it will subtract fuel from the air-fuel mixture if there is a rich condition by varying the pulse width, or the duty cycle, of the PWM signal sent to the fuel injectors 16. Therefore, the ECU continuously controls the engine fuel injectors so the AFR is maintained close to the ideal stoichiometric AFR ($AFR_{Stoich}$).

It will be noted that most technical books and articles discuss an "excess air factor," or lambda ($\lambda$), instead of AFR, with $\lambda$, being the ratio of the actual AFR to the stoichiometric AFR. Thus, a $\lambda=1.0$ represents stoichiometric combustion. Lambda is used because various fuels combine differently, and a strict weight ratio of 14.7 parts of air to one part of fuel is applicable only for a specific fuel. When $\lambda$ is utilized, a rich condition has $\lambda<1.0$, while a lean condition has $\lambda>1.0$. However, AFR is used in calculations to determine an actual quantity of fuel. For a given intake stroke, a finite quantity of air is acquired. Thus, fuel volume is utilized as the only variable to obtain a different AFR.

In the U.S., Europe, and Japan, catalytic after-treatment of engine exhaust gas using a catalytic converter gas has proven to be the only means of complying with the present limits for CO, NO, and HC. Catalytic converters function most effectively when $\lambda=1$. Therefore, engine controllers are designed to operate within a narrow range with $\lambda=1.0\pm0.005$.

In order to enhance engine performance, current available systems can control AFR by using a wide band $O_2$ sensor, while still providing a narrow band $O_2$ signal to the ECU, as illustrated by the engine control system 20 shown in FIG. 4. Components shown in FIG. 4 that are the same as components shown in FIG. 1 have the same numerical identifiers. As shown in FIG. 4, both a wide band $O_2$ sensor 22 and a Fuel Injector Controller (FIC) 24 have replaced the narrow band $O_2$ sensor 12 shown in FIG. 1. The FIC 24 is responsive to the output signal received from the wide band $O_2$ sensor 22 to generate a false narrow band signal that is sent to the ECU 14. The false narrow band signal causes the ECU to add or subtract fuel. If a lower AFR is desired, a low narrow band $O_2$ signal is sent to the ECU so that fuel is added. Similarly, if a higher AFR is desired, a high narrow band $O_2$ signal is sent to the ECU so that fuel is subtracted.

The system 20 may encounter problems with newer ECUs, in which sensors are cross checked with other systems. For example, a mass air flow sensor (not shown) can calculate the amount of engine input air, which can be compared to the PWM signal being sent to the fuel injectors 16. With the system 20 shown in FIG. 2, the amount of engine input air will not compare satisfactorily with the output injector pulse width, causing the ECU to generate an error signal. Accordingly, it would be desirable to be able to utilize a wide band $O_2$ sensor with the newer ECUs without an error signal being generated.

SUMMARY OF THE INVENTION

This invention contemplates a supplemental fuel injection controller that controls fuel delivery while providing signal/s to the ECU that correlate to stock fuel injection signals.

The invention includes a control system for an internal combustion engine that includes at least one fuel injector for the internal combustion engine and an engine control unit that is operable to generate a pulse width modulated control signal for the at least one fuel injector that may be a function of an $O_2$ sensor input signal. The system also includes an $O_2$ sensor that is operable to generate an output signal that is a function of the amount of oxygen present at the sensor. The system further includes an enhanced fuel injection controller connected to the $O_2$ sensor, the engine controller, and the at least one fuel injector. The enhanced fuel injection controller is responsive to the $O_2$ sensor output signal to generate and send a false $O_2$ sensor signal to the ECU. The enhanced fuel injection controller also may be operative to send a desired PWM control signal to the at least one fuel injector, with the desired PWM control signal being a function of the wide band oxygen sensor output signal. Alternately, the system may operate in an open loop mode, in which the signal received from the $O_2$ sensor is not utilized.

The enhanced fuel injection controller also is operative to receive the PWM control signal from the engine control unit and to generate the false $O_2$ sensor signal as a function of the PWM control signal received from the engine control unit.

The invention also includes a method for controlling an internal combustion engine that includes providing an enhanced fuel injection controller having a first input port that is connected to an $O_2$ sensor and a second input port that is connected to the output of an engine control unit. The enhanced fuel injection controller also has an output port that is connected to at least one fuel injector. The method also includes the steps of receiving an output signal from the $O_2$ sensor at the input port of the enhanced fuel injection controller and generating a desired control signal for the at least one fuel injector with the enhanced fuel injection controller that is a function of the $O_2$ sensor output signal and the ECU output signal.

The method further contemplates that the enhanced fuel injection controller also generates a false $O_2$ sensor signal, which is sent to an oxygen sensor input port on the ECU.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
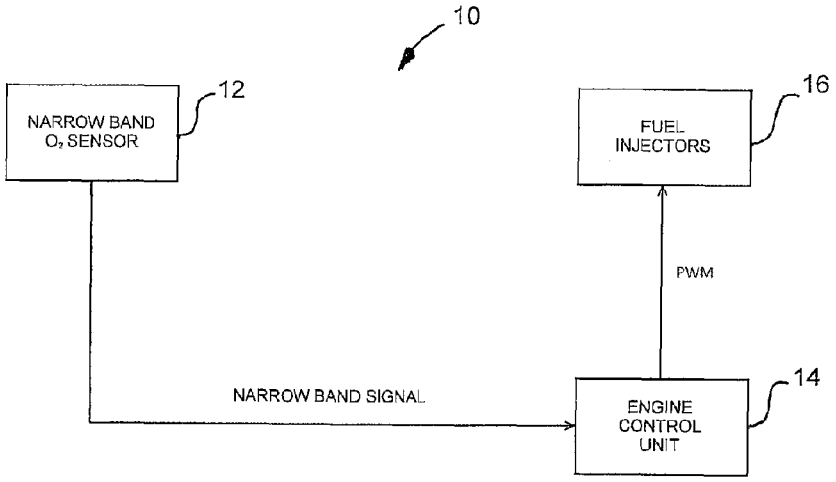
FIG. 1 (PRIOR ART)
FIG. 1 is a schematic diagram illustrating a prior art internal combustion engine control system.
Figure 2:
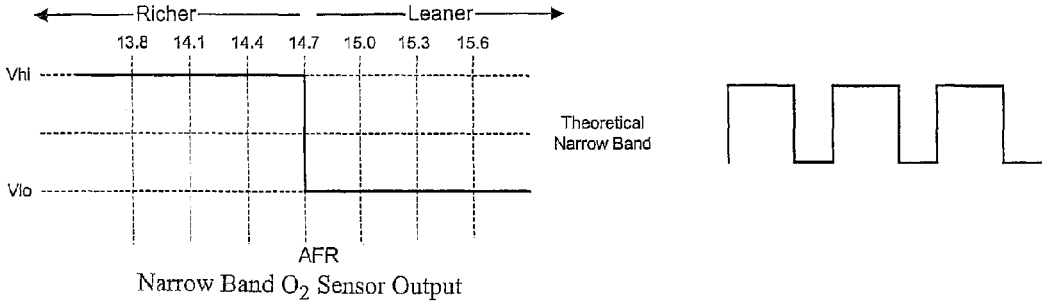
FIG. 2 (PRIOR ART)
FIG. 2 illustrates a pair of graphs, wherein the left graph shows the ideal relationship between AFR and a narrow band $O_2$ sensor output voltage, and the right graph shows the sensor output signal as a function of time.
Figure 3:
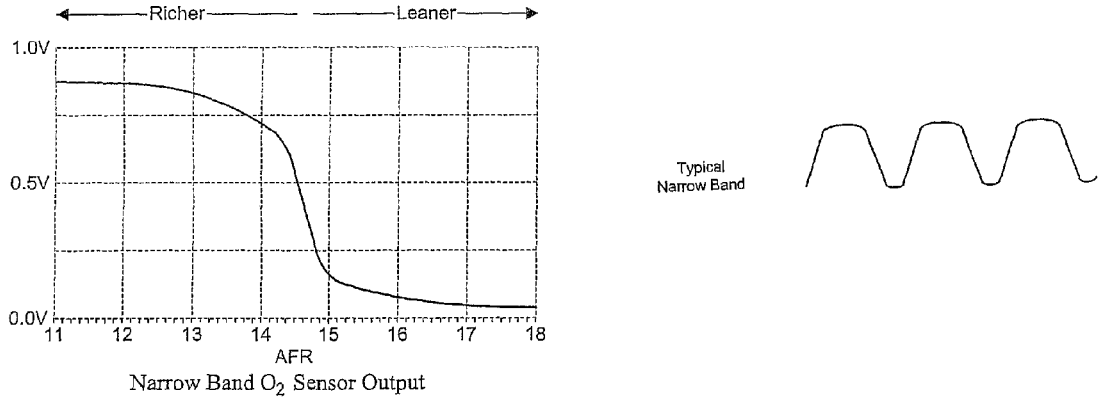
FIG. 3 (PRIOR ART)
FIG. 3 illustrates a pair of graphs, wherein the left graph shows the typical relationship between AFR and a narrow band $O_2$ sensor output voltage, and the right graph shows the sensor output signal as a function of time.
Figure 4:
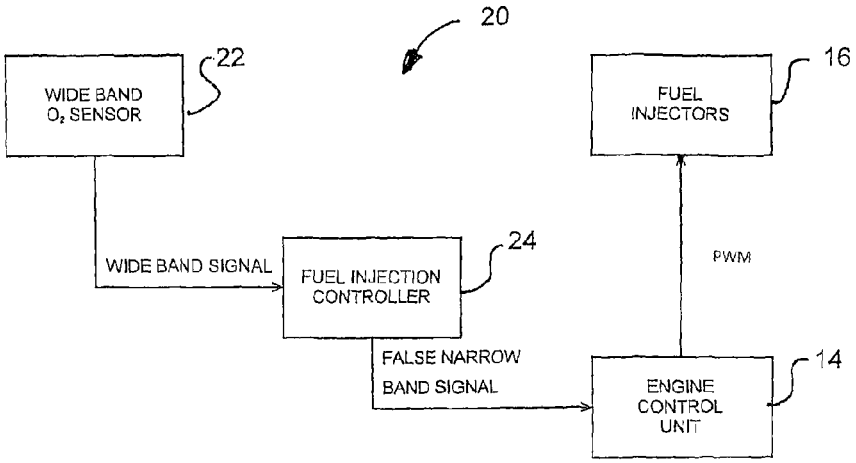
FIG. 4 (PRIOR ART)
FIG. 4 a schematic diagram illustrating another prior art internal combustion engine control system.
Figure 5:
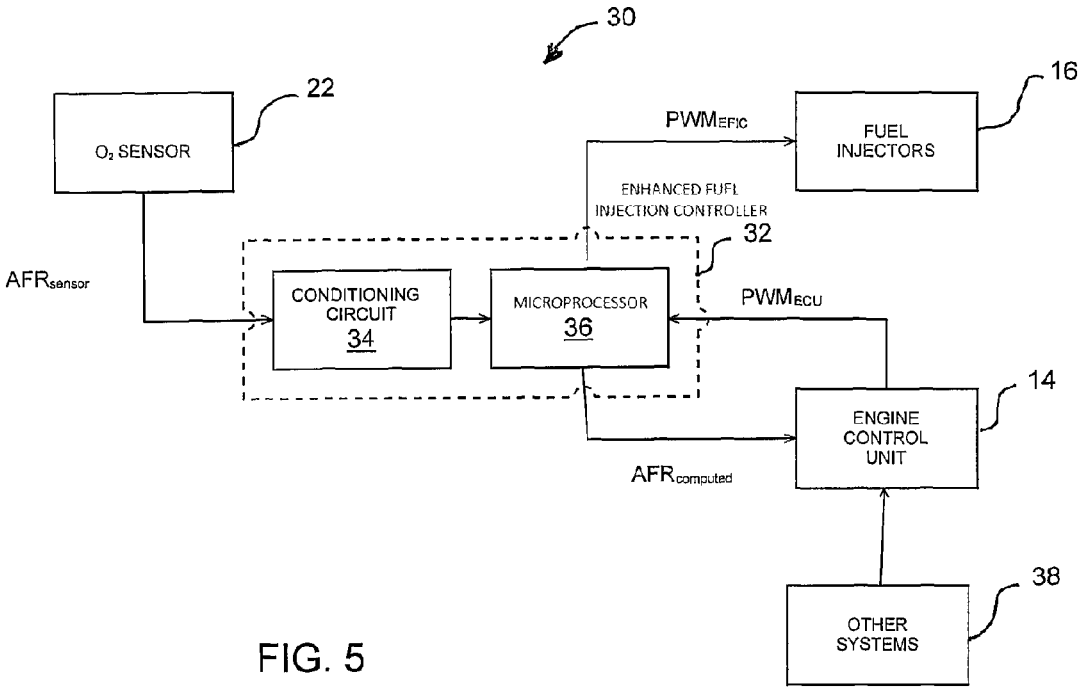
FIG. 5 is a schematic diagram illustrating an internal combustion engine control system that is in accordance with the present invention.

Referring now to the drawings, there is illustrated in FIG. 5 a schematic diagram illustrating an internal combustion engine control system 30 that is in accordance with the present invention. Components shown in FIG. 5 that are similar to components shown in FIGS. 1 and 4 have the same numerical identifiers. As shown in FIG. 5, the control system 30 includes an $O_2$ sensor 22, which may be either a wide band $O_2$ sensor or a narrow band $O_2$ sensor. The system 30 also includes an Enhanced Fuel Injector Controller (EFIC) 32 that both sends and receives signals from the ECU 14. The EFIC 32 includes a conditioning circuit 34 and a microprocessor 36, with the conditioning circuit 34 conditioning the output signal from the $O_2$ sensor 22. The $O_2$ sensor 22 output signal $AFR_{sensor}$ is then supplied to an $O_2$ sensor input port of the EFIC 32. As will be described below, the EFIC 32 generates a computed, or false, AFR signal ($AFR_{computed}$) that is supplied to the ECU 14. The ECU is responsive to the $AFR_{computed}$ signal to generate a PWM output ($PWM_{ECU}$) that is sent to the EFIC 32. Other sensors (which are shown as a single block 38 in FIG. 5) are connected to the ECU. Such other sensors 38 may be utilized to crosscheck with the AFR determined by the stock systems narrow band $O_2$ sensor reading. The EFIC then generates a PWM output ($PWM_{EFIC}$) that is used to control the fuel injectors 16. The PWM signal controlling the fuel injectors 16 may either be open loop or closed loop.

It is noted that the engine control system 30 shown in FIG. 5 is operated in a closed loop mode of operation. Closed loop control modifies the injector pulse width dependent upon the wide band $O_2$ signal to maintain a specified AFR. The closed loop method may vary. A conventional closed loop control feedback method using Proportional, Integral, Derivative (PID) control modifies the PWM dependent upon the relationship of a target AFR to a sensor AFR as determined by the $O_2$ sensor 22 according to conventional methods. A computed closed loop method calculates a new PW signal with the EFIC 32 by utilizing the target AFR and sensor AFR values to directly calculate a new injector pulse width. For a finite quantity of air, the operation of the system 30 can be described by the following equation:

$$AFR_{sensor}*FUEL_{EEIC}=AFR_{target}*FUEL_{computed};$$

where $AFR_{sensor}$ is the AFR as read by the $O_2$ sensor, $FUEL_{EFIC}$ is the fuel quantity controlled by the EFIC, which is a function of $PWM_{EFIC}$, $FUEL_{computed}$ is a new fuel quantity calculated by the ECU, which is a function of $PWM_{ECU}$, and $AFR_{target}$ is the desired AFR.

The above equation may be solved for the new fuel quantity, $FUEL_{computed}$, as:

$$FUEL_{computed}=(AFR_{sensor}*FUEL_{EEIC})/AFR_{target}, \text{ or}$$

$$fn(PWM_{new})=(AFR_{sensor}*fn(PWM_{EFIC}))/AFR_{target}.$$

The EFIC 32 uses an algorithm to characterize a relationship between $FUEL_{EFIC}$ and $PWM_{target}$. The algorithm may include either an equation and/or a lookup table.

Figure 6:
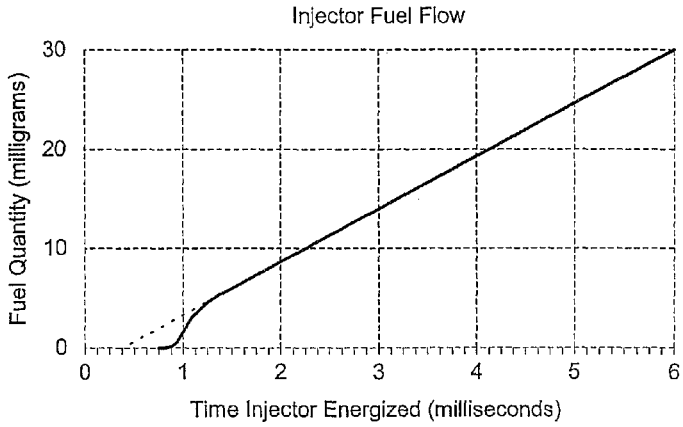
FIG. 6 illustrates the amount of fuel delivered by an injector as a function of time.

The quantity of fuel delivered by a fuel injector is not directly proportional to the time that the injector is powered, as illustrated in FIG. 6. An equation or a second lookup table may be used to correlate fuel delivered by an injector to the time the injector is on. A common approximation is to define the difference between the time an injector is powered and the time fuel flows. This constant is called the injector turn-on, lag, or dead time. Fuel quantity with respect to injector pulse width may be defined using the injector turn-on time approximation as:

$$FUEL=RATE_{inj}*(PW-C); \text{ where}$$

FUEL is the fuel quantity delivered by an injector, $RATE_{inj}$ is the flow rate for the injector, PW is the duration the injector is powered, and C is the injector turn-on time.

Combining the aforementioned equations, the computed AFR received by the ECU may be calculated relative to the time the injector is powered as follows:

$$PW_{computed}=[AFR_{sensor}*(PW_{EFIC}-C)]/(PW_{ECU}-C);$$

where $PW_{EFIC}$ is the previous pulse width from the EFIC powering the injector which resulted in the measured AFR, $AFR_{sensor}$, and $PW_{computed}$ is a new pulse width from the ECU to the EFIC.

The above equation shows that the AFR, as determined by the wide band $O_2$ sensor, is not coincident to the fuel currently being delivered by the injectors as controlled by the EFIC. This is due to the fact that a finite time elapses between when the fuel is delivered, the combustion occurs, and the exhaust travels to, and is measured by, the $O_2$ sensor. Some method must be used to match the AFR as measured by the wide band $O_2$ sensor to the PW output by the EFIC. The preferred method is to synchronize the measurement of the $O_2$ value relative to the engine rotation and, thus, to the time the PW was output by the EFIC, and also to maintain a recorded history of those PW durations. The PW which caused the current AFR value may then be obtained from that history, which provides a fixed index.

If the computed AFR is less than the stoichiometric AFR, then a rich condition exists, and a false low signal $O_2$ is output from the EFIC 32 to the ECU 14. If the computed AFR is greater than the stoichiometric AFR, then a lean condition exists, and a false high $O_2$ signal is output from the EFIC 32 to the ECU 14. These relationships are illustrated by the following equations:

if $AFR_{computed} > AFR_{Stoich}$, a false low $O_2$ signal is sent to the ECU 14, and;

if $AFR_{computed} < AFR_{Stoich}$, a false high $O_2$ signal is sent to the ECU 14.

Thus, the ECU 14 continues to operate in a normal manner as in prior art devices, and the output signal $PWM_{ECU}$ from the ECU will be compared within other vehicle sensors 38 to other sensor signals without triggering an error signal. Accordingly, the present invention will not have the problem described above involving mismatched sensor output signals since the output pulse width $PWM_{ECU}$ from the ECU would be ideal for a stoichiometric AFR, while the EFIC output pulse width $PW_{EFIC}$ is actually being supplied to the fuel injectors 16.

As noted above, it is also possible to utilize the EFIC 32 and the ECU 14 in an open loop mode of operation in which the $O_2$ sensor 22 is not utilized. Open loop control modifies the PWM signal independent of the wide band $O_2$ signal. The duration of the injector pulse supplied by the EFIC 32 to the fuel injectors may be either fixed or variable relative to the pulse width output by the ECU.

Figure 7:
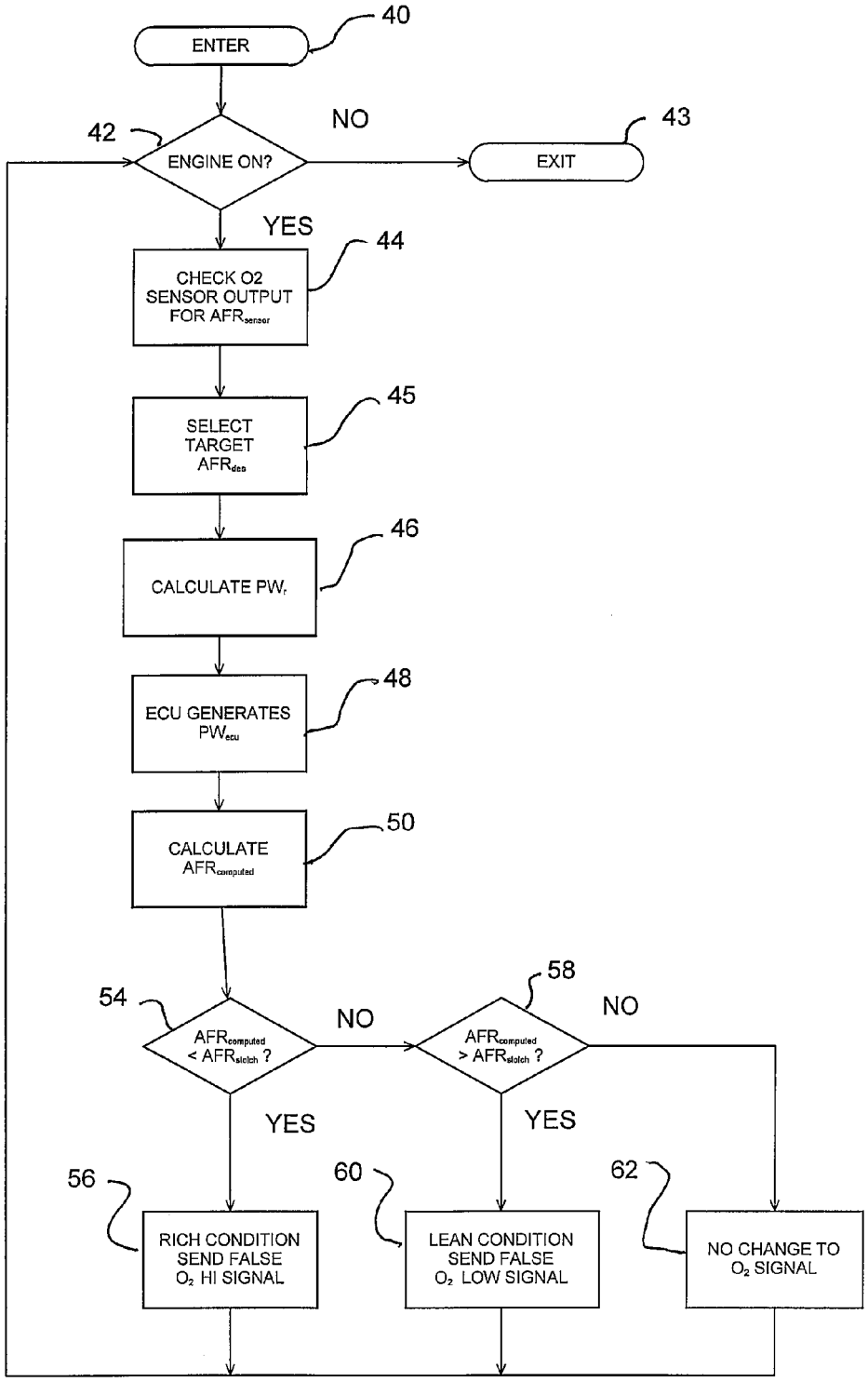
FIG. 7 is a flow chart for an algorithm for the operation of the internal combustion engine control system shown in FIG. 3.

The present invention also contemplates an algorithm for controlling the operation of an internal combustion engine that is illustrated by the flow chart shown in FIG. 7. The algorithm is entered through block 40 and proceeds to decision block 42 where it is determined whether the engine is running. If the engine is not running, the algorithm exits through block 43. If the engine is running, the algorithm transfers to functional block 44 where the output of the $O_2$ sensor is checked for $AFR_{sensor}$. The algorithm then continues to functional block 45 where a target AFR, $AFR_{des}$, is selected for the required engine performance. The target AFR may be a function of the $O_2$ sensor signal, $AFR_{sensor}$, or a function of another engine parameter, such as, for example, throttle position. The algorithm then advances to functional block 46 where the EFIC 32 calculates desired pulse width, $PW_r$, that can be a function of the target AFR. The algorithm then continues to functional block 48 where the ECU 14 generates an ECU output pulse width, $PW_{ecu}$, which is needed by the EFIC 32 to calculate the computed AFR, $AFR_{computed}$, that is sent to the EFIC 32. Accordingly, the algorithm advances to functional block 50, where $AFR_{computed}$ is determined. The algorithm then continues to decision block 54.

If, in decision block 54, $AFR_{computed}$ is less than $AFR_{Stoich}$, a rich condition exists, and the algorithm transfers to functional block 56, where a rich condition false $O_2$ high signal is sent to the ECU 14. The algorithm then transfers back to functional block 42 for another iteration. If, in decision block 54, it is determined that $AFR_{computed}$ is not less than $AFR_{Stoich}$, the algorithm transfers to decision block 58.

If, in decision block 58, $AFR_{computed}$ is greater than $AFR_{Stoich}$, a lean condition exists and the algorithm transfers to functional block 60 where a lean condition false $O_2$ low signal is sent to the ECU 14. The algorithm then transfers back to functional block 42 for another iteration. However, if, in decision block 58, $AFR_{computed}$ is not greater than $AFR_{Stoich}$, the algorithm transfers to functional block 62 where the $O_2$ signal from the previous iteration is sent to the ECU 14. The algorithm then transfers back to functional block 42 for another iteration.

Figure 8:
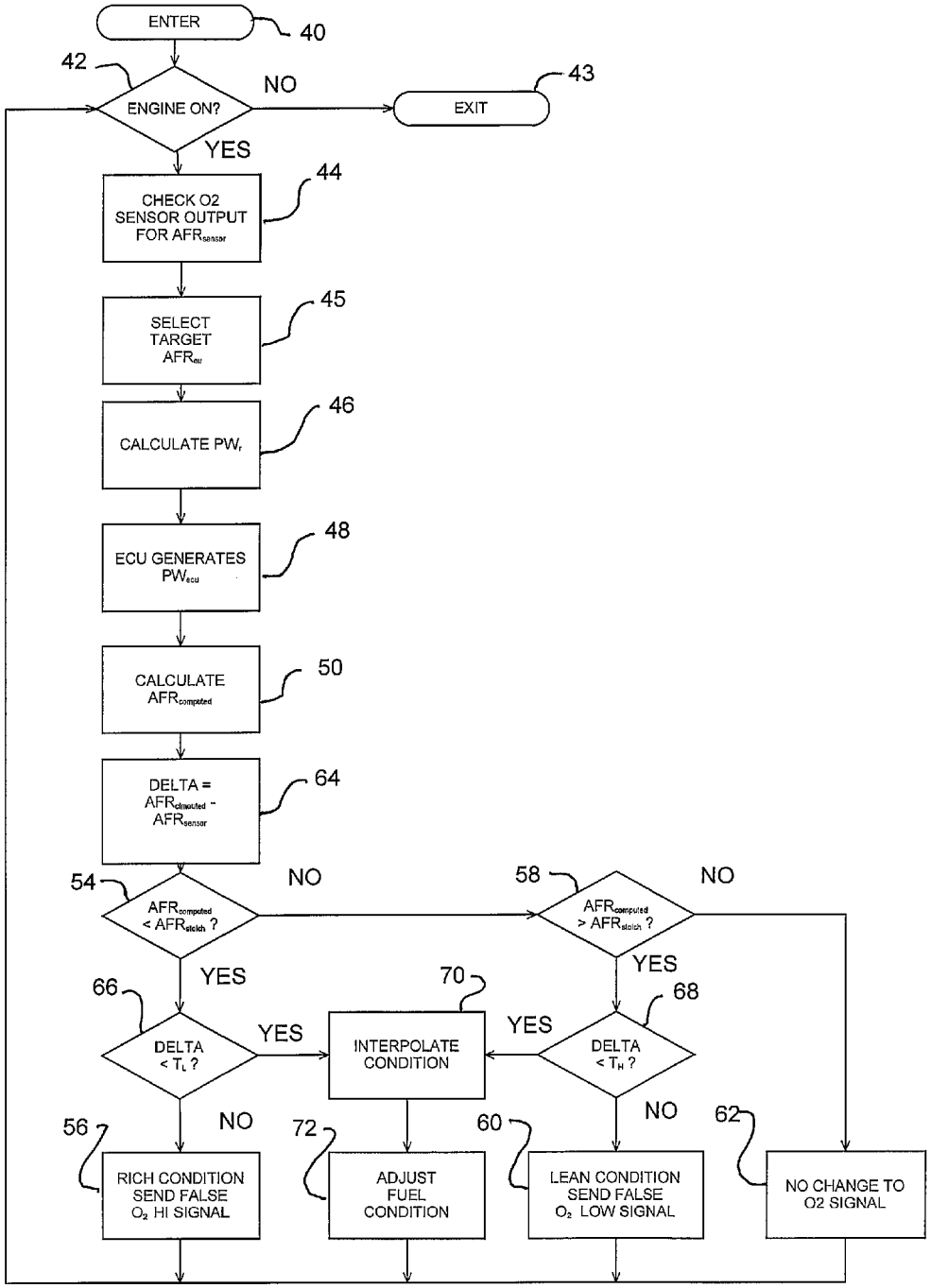
FIG. 8 is a flow chart for an alternate embodiment of the algorithm shown in FIG. 4.

An alternate algorithm that includes interpolation is shown in FIG. 8, where blocks that are similar to blocks shown in FIG. 4 have the same numerical designators. A narrow band $O_2$ sensor, such as a Nernst cell, indicates the existence or absence of oxygen and yields two stable conditions: rich or lean. However, within a narrow $\lambda$, range of perhaps 0.995 to 1.005, the signal transitions between the two extremes. Creating just a high or low signal (a square wave) is the roughest approximation to a narrow band sensor. The alternate algorithm shown in FIG. 8 interpolates a voltage between the two extremes while within the very narrow band close to $\lambda=1.0$.

The alternate algorithm proceeds as described above through functional block 50 after which the difference, DELTA, between $AFR_{computed}$ and $AFR_{sensor}$ is determined in functional block 64. The algorithm then continues as described above except that decision blocks 66 and 68 have been added after decision blocks 54 and 58, respectively. In decision blocks 66 and 68, DELTA is compared to a high threshold $T_H$ and a low threshold $T_L$, respectively. The threshold values $T_H$ and $T_L$ are just above and below the stoichiometric AFR, with typical values being 14.72 and 14.68, respectively, but also depending upon the specific fuel being used. Alternately, a lambda $\lambda$ of $1.0 \pm 0.005$ may be utilized. The present invention also contemplates that the threshold values $T_H$ and $T_L$ may be a variable function of a engine parameter, such as, for example, throttle opening, and/or a vehicle parameter, such as, for example, vehicle speed. If in either decision block 66 or 68, it is determined that DELTA falls between $T_H$ and $T_L$, the algorithm transfers to functional block 70.

In functional block 70 an interpolated false narrow band $O_2$ signal is determined and sent to the ECU 14. Within the band between $T_H$ and $T_L$, the ECU makes smaller changes in the PWM than provided in decision blocks 56 and 62. It is also contemplated that the change may be made proportional to the magnitude of DELTA and that the changes may have different magnitudes depending upon which threshold triggers the interpolation step. The algorithm then continues to functional block 72 where the fuel condition is adjusted in either a rich or lean direction and in an amount determined by the interpolation that occurs in functional block 70.

The interpolation described above is an improved approximation but is still just that, an approximation. The present invention also contemplates using more complex methods to improve the approximation (not shown). It is also contemplated that the ECU corrects the fuel by a lessening amount as $\lambda$ approaches 1.0. This makes the improved approximation perform better. Following functional block 70, the algorithm transfers back to decision block 42 for the next iteration.

The high and low threshold values, $T_H$ and $T_L$ are determined for the specific engine being controlled and/or the expected service environment. Typically, the threshold values would be just above and below the stoichiometric AFR for the engine. For example, the invention contemplates that $T_H$ may be set at 1.2, while $T_L$ may be set at 0.8; however, other values may be used for the threshold values.

It will be appreciated that the algorithms shown in FIGS. 7 and 8 are meant to be exemplary and that the invention may also be practiced with algorithms that differ from the ones shown.

While the invention has been described and illustrated for both narrow and wide band $O_2$ sensors, the invention contemplates that a wide band $O_2$ sensor is used for improved engine performance. A wide band $O_2$ sensor outputs a signal based on the AFR over a wide range. This allows the ECU to maintain the AFR at any value. The present invention contemplates that Stoichiometric AFR is used to create the cleanest emissions from the engine. However, the invention can also be practiced with an AFR other than the Stoichiometric AFR in order to produce more power and/or better efficiency. When a wide band $O_2$ sensor is used to determine the $AFR_{sensor}$ for improved engine performance, the EFIC 32 will provide an apparent AFR, $AFR_{computed}$, to the ECU 14 while also providing $PW_{EFIC}$ to the fuel injectors 16 that provides the desired enhanced engine performance. The use of the apparent AFR, $AFR_{computed}$, sent to the ECU 14 assures that any cross checking with other vehicle sensors by the ECU 14 will not trigger any alarm signals.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope. Thus, while the preferred embodiment has been described and illustrated as utilizing $O_2$ sensors, it will be appreciated that the invention also may be used with other type of sensors, such as, for example, mass flow sensors.

What is claimed is:

1. A control system for an internal combustion engine having at least one fuel injector, the control system comprising:

an oxygen sensor that is operable to generate an output signal that is a function of the amount of oxygen present at the oxygen sensor;

an engine control unit (ECU) that is configured to generate a pulse width modulated control signal that is a function of the oxygen sensor output signal; and an enhanced fuel injection controller (EFIC) that is connected to both the oxygen sensor and the engine controller and is adapted to be connected to at least one fuel injector of an internal combustion engine, the enhanced fuel injection controller configured to be responsive to the oxygen sensor output signal to generate and a false oxygen sensor signal to the engine control unit and to generate a desired pulse width modulated control signal for use by the at least one fuel injector that is a function of the oxygen sensor output signal.

2. The control system according to claim 1 wherein the enhanced fuel injection controller also receives the pulse width modulated control signal from the engine control unit, and wherein the false oxygen sensor signal generated by the enhanced fuel injection controller is also a function of the pulse width modulated control signal.

3. The control system according to claim 1 wherein the oxygen sensor is a wide band oxygen sensor that generates a wide band output signal that is a function of the amount of oxygen present at the oxygen sensor, and wherein the enhanced fuel injection controller is responsive to the wide band oxygen sensor output signal to generate and send the false signal.

4. The control system according to claim 1 wherein the oxygen sensor is a narrow band oxygen sensor that generates a narrow band output signal that is a function of the amount of oxygen present at the oxygen sensor, and wherein the enhanced fuel injection controller is responsive to the narrow band oxygen sensor output signal to generate and send the false signal.

5. The control system according to claim 1 wherein the oxygen signals and an amount of fuel supplied to the internal combustion engine are related by the following relationships:

$$AFR_{sensor}*FUEL_{EFIC}=AFR_{target}*FUEL_{computed};$$

where $AFR_{sensor}$ is an air to fuel ratio (AFR) as read by the $O_2$ sensor, $FUEL_{EFIC}$ is a fuel quantity controlled by the EFIC, $FUEL_{computed}$ is a new fuel quantity calculated by the ECU, and $AFR_{target}$, is a desired AFR, and wherein $$FUEL=RATE_{inj}*(PW-C);\text{ where}$$

FUEL is a fuel quantity delivered by a fuel injector, $RATE_{inj}$ is a flow rate for the fuel injector, PW is a duration that the fuel injector is powered, and C is a turn-on time for the fuel injector.

6. The control system according to claim 5 wherein the oxygen signals and the pulse width modulated control signals are related by the following relationships:

$$AFR_{current}*(PW_{current}-C)=AFR_{ecu}*(PW_{ecu}-C),\text{ and}$$

$$AFR_{sensor}*(PW_{EFIC}-C)=AFR_{computed}*(PW_{ECU}-C),$$

where $PW_{EFIC}$ is a pulse width from the EFIC powering the injector, and $PW_{ECU}$ is a pulse width from the ECU to the EFIC.

7. The control system according to claim 5, wherein if the computed AFR is less than a stoichiometric AFR, then a false low signal $O_2$ is output from the EFIC to the ECU, and further wherein if the computed AFR is greater than the stoichiometric AFR, then a false high $O_2$ signal is output from the EFIC to the ECU.

8. The control system according to claim 5, wherein a computed AFR received by the ECU is calculated relative to a time that the fuel injector is powered by:

$$PW_{computed}=[AFR_{sensor}*(PW_{EFIC}-C)]/(PW_{ECU}-C),$$

where $PW_{EFIC}$ is a previous pulse width from the EFIC powering the injector which resulted in the measured AFR, $AFR_{sensor}$, and $PW_{computed}$ is a new pulse width from the ECU to the EFIC.

9. The control system according to claim 5, wherein a computed AFR received by the ECU is calculated relative to the time the injector is powered by:

$$PW_{computed}=[AFR_{sensor}*(PW_{EFIC}-C)]/(PW_{ECU}-C);$$

where $PW_{EFIC}$ is the previous pulse width from the EFIC powering the injector which resulted in the measured AFR, $AFR_{sensor}$, $PW_{computed}$ is a new pulse width from the ECU to the EFIC, and C is the injector turn on time.

* * * * *